United States Patent [19]

Thiele et al.

[11] 4,244,382

[45] Jan. 13, 1981

[54] METHOD AND APPARATUS FOR DELIVERING PARTICLES OF TOBACCO TO SHREDDING MACHINES

[75] Inventors: Willi Thiele, Geesthacht; Klaus-Georg Hackmack, Hamburg; Reinhard Hohm, Pinneberg, all of Fed. Rep. of Germany

[73] Assignee: Hauni-Werke Körber & Co. KG, Hamburg, Fed. Rep. of Germany

[21] Appl. No.: 60,239

[22] Filed: Jul. 23, 1979

Related U.S. Application Data

[63] Continuation-in-part of Ser. No. 20,520, Mar. 14, 1979.

[51] Int. Cl.[3] ..... A24B 7/14; B65G 37/00; B65C 27/08

[52] U.S. Cl. ..... 131/21 B; 131/109 AB; 198/572; 198/765; 198/771; 198/533

[58] Field of Search ..... 131/145, 108–109, 131/109 B, 109 AB, 145, 146, 21 B; 198/572, 573, 765, 771, 358, 752, 533

[56] References Cited

U.S. PATENT DOCUMENTS

| | | | |
|---|---|---|---|
| 3,817,257 | 6/1974 | Andriola et al. | 131/109 AB |
| 4,090,521 | 5/1978 | Elsner | 131/109 R |
| 4,149,547 | 4/1979 | Komossa et al. | 131/109 AB |

*Primary Examiner*—Stephen C. Pellegrino
*Attorney, Agent, or Firm*—Peter K. Kontler

[57] ABSTRACT

The channel between the convergent tobacco compacting upper and lower chain conveyors of a tobacco shredding machine receives particles of tobacco from one or more vibrating troughs which define paths extending in parallelism with the direction of travel of particles between the chain conveyors toward the cutting station. The troughs can have stepped bottom walls to effect preliminary homogenization and compacting of particles on their way toward the rear portion of the lower conveyor which extends rearwardly beyond the upper conveyor. The quantity of tobacco particles in one or more troughs is monitored by photocells whose signals are utilized to vary the speed of the motor for the chain conveyors, the frequency and/or amplitude of vibratory movements of the trough or troughs and/or the rate of feed of particles to the trough or troughs when the monitored quantity deviates from a desirable range of quantities. The front portion of each trough can be vibrated in such a way that it performs recurrent movements having predominantly vertical components, and the rear portion of each trough can be vibrated to perform recurrent movements having predominantly horizontal components. This is achieved by mounting the front portion on leaf springs which make with the bottom wall of the respective trough a relatively small acute angle, and by mounting the rear portion on leaf springs which make with the bottom wall a relatively large acute angle.

21 Claims, 5 Drawing Figures

CONTROL CIRCUIT
32a
32
2
33
29
27
31
1
3
4
4b
8
9
11
17
19
12
13
6a
A
B
6
6b
2B
27a
7
16
14
18
CK
22
22a
24
24a
26
21
23
23a
PC
F 104
103
101
B
133
102
131
129
127
127a
CK
A
106

204
203
201
227
B
202
233
235a
235b
229
231
235
206

301
302
303
304
306
329
331
327

CONTROL CIRCUIT
432a
432
433
402
401
403
404
404b
408
409
411
412
413
417
419
421
423
423a
424
424a
426
422
422a
427
428a
428b
436
437
438
F
B
A
CK
418
414
416
406
406a
406b
407
PC

METHOD AND APPARATUS FOR DELIVERING PARTICLES OF TOBACCO TO SHREDDING MACHINES

CROSS-REFERENCE TO RELATED APPLICATION

This is a continuation-in-part of our copending application Ser. No. 20,520 filed Mar. 14, 1979.

BACKGROUND OF THE INVENTION

The present invention relates to a method and apparatus for delivering particles of tobacco to a tobacco cutting machine, particularly to the system which transports a cake of tobacco particles into the range of one or more knives in a tobacco shredding machine.

Presently known tobacco shredding machines comprise convergent upper and lower chain conveyors which deliver a cake of condensed tobacco particles into the range of orbiting knives on a rotary carrier whereby the knives cut across the leader of the cake and convert the particles into smaller fragments or shreds which are delivered to a conditioning unit prior to transport into the magazine of a cigarette maker. The rear end of the lower chain conveyor extends beyond the rear end of the upper chain conveyor and receives a shower of tobacco particles from a duct. A rake or an analogous device is provided to push the descending particles into the space between the two chain conveyors whereby the conveyors convert the stream into the aforementioned cake whose density increases on the way toward the cutting station. The just described cutting machines are used for comminution of tobacco leaf laminae and/or tobacco ribs.

A drawback of presently known systems which deliver tobacco particles to the chain conveyors of a shredding machine is that the particles which form the cake are oriented in random fashion. This affects the homogeneousness of the cake and often results in extraction (rather than severing) of relatively large particles from the front end of the cake. Large fragments of ribs are likely to affect the quality of the filler of a cigarette rod and/or to puncture the wrapping material (cigarette paper) which is used to convert the filler into a rod ready to be subdivided into discrete cigarettes or analogous smokers' products.

OBJECTS AND SUMMARY OF THE INVENTION

An object of the invention is to provide a novel and improved method of delivering particles of tobacco to the transporting and compacting or condensing unit of a tobacco cutting machine in such a way that the resulting cake is more homogeneous than the cakes which are formed in heretofore known cutting machines.

Another object of the invention is to provide a method which insures predictable orientation of all or nearly all particles of tobacco on their way toward and in the compacting or condensing zone.

A further object of the invention is to provide a method which insures that the cutting machine can produce a large number of elongated tobacco shreds which are best suited for conversion into the filler of a cigarette rod or the like.

Another object of the invention is to provide a method which insures that the orientation of tobacco particles does not change as a result of contact with particles in the compacting zone.

An additional object of the invention is to provide a novel and improved apparatus which can be combined with or incorporated in tobacco cutting machines to insure the formation of a homogeneous cake consisting of compacted tobacco ribs and/or tobacco leaf laminae.

Another object of the invention is to provide a relatively simple apparatus which contributes to compactness of the cutting machine and which can be installed in existing cutting machines as a superior substitute for conventional tobacco delivering systems.

A further object of the invention is to provide novel and improved conveyor means for use in the above outlined delivering apparatus.

Another object of the invention is to provide an apparatus which insures uninterrupted delivery of properly oriented particles to the condensing station irrespective of minor and/or pronounced fluctuations of the feed of such particles to the orienting station.

An ancillary object of the invention is to provide a tobacco delivering apparatus which can advance particles of tobacco at a predictable rate and which insures optimum orientation of tobacco particles prior to and during conversion of such particles into a cake.

One feature of the invention resides in the provision of a method of comminuting particles of tobacco, such as tobacco ribs or tobacco leaf laminae wherein a stream of tobacco particles is built up at a location remote from a cutting station and is transported lengthwise toward the cutting station, and wherein the stream is condensed during transport toward the cutting station. In accordance with the invention, the improvement comprises the steps of conveying particles of tobacco toward the aforementioned location (which can be called a stream building zone) substantially in the longitudinal direction of the stream, and agitating the particles in the course of the conveying step. The stream is preferably transported along a substantially horizontal path whose cross-sectional area decreases in a direction from the stream building zone toward the cutting station, and the conveying step then comprises advancing the particles of tobacco along at least one second substantially horizontal path whose discharge end or outlet is disposed at the stream building zone.

The agitating step may comprise vibrating the particles in the second path or paths to thereby orient the particles in the second path or paths in such a way that at least the majority of particles which reach the stream building zone are substantially horizontal and extend substantially transversely of the stream.

The improvement preferably further comprises the steps of feeding particles of tobacco into each second path at a variable rate, monitoring the quantity of tobacco particles in at least one second path, and varying the rate at which the particles are supplied when the monitored quantity deviates from a predetermined range of quantities. For example, the monitoring step may include the utilization of one or more level detectors which scan the height of the mass of tobacco particles in a predetermined portion of a second path and a control system which regulates the rate of feed when the monitored height is outside of an optimum range of heights.

If the conveying step includes advancing the particles of tobacco along a plurality of second paths, such second paths are preferably substantially parallel to and may be disposed above each other. At least one second path may include a plurality of successive sections, and each preceding section of such second path is preferably disposed at a level above the next-following section so that the particles descend during transfer from a preceding section into the next-following section of such second path.

It is also within the purview of the invention to resort to an agitating step which includes imparting to the particles of tobacco in a first portion of the second path (namely, in that portion which is nearer to the aforementioned location) a first recurrent movement having a predominantly vertical component and imparting to the particles of tobacco in a second portion of the second path (namely, in that portion which is ore distant from the aforementioned location) a second recurrent movement having a predominantly horizontal component. Such method is especially suited for the transport of tobacco ribs and insures that oriented particles of tobacco do not change their desirable orientation upon arrival at the rear end of the compacting zone, namely, when they come into contact with partially compacted particles. Moreover, the just described version of the improved method insures uninterrupted delivery of tobacco particles to the condensing zone irrespective of minor and/or pronounced fluctuations in the rate of feed of particles into the orientating zone, i.e., into the second path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
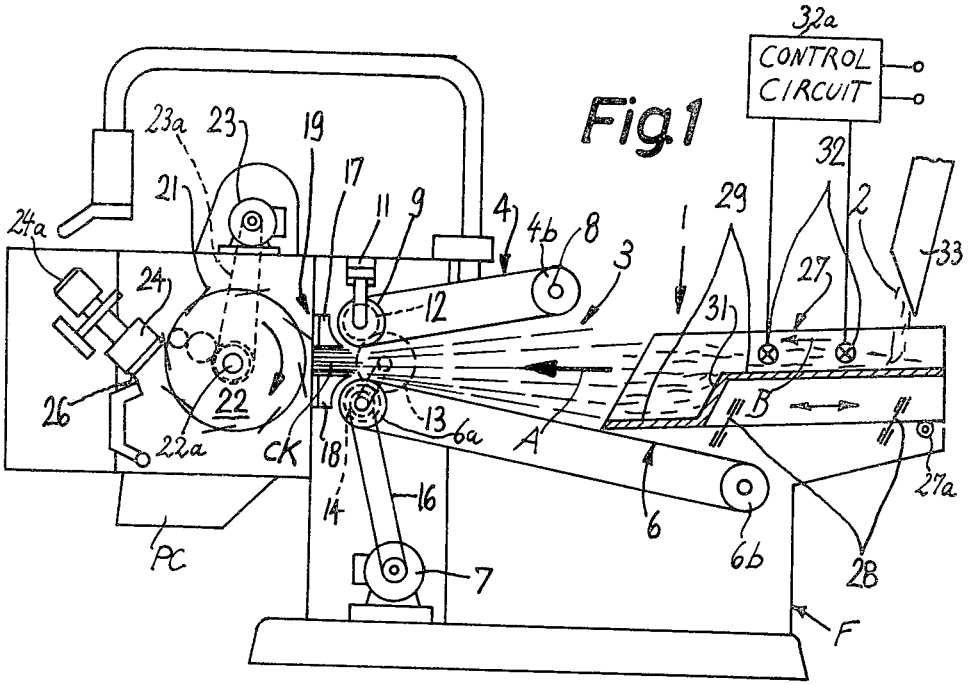
FIG. 1 is a schematic side elevational view of a tobacco shredding machine and a schematic partly longitudinal sectional view of a tobacco delivering apparatus which embodies one form of the invention and comprises a single conveyor constituting a vibrating trough for tobacco particles.

FIG. 1 shows a tobacco cutting or shredding machine which comprises a frame or support F for a transporting unit 3 including an upper endless chain conveyor 4 and a lower endless chain conveyor 6. Th lower reach of the conveyor 4 slopes forwardly and downwardly, and the upper reach of the conveyor 6 slopes upwardly and forwardly so that such reaches define a substantially horizontal elongated path A wherein particles of tobacco (e.g., tobacco ribs 2) are transported in a direction to the left, i.e., in the longitudinal direction of the stream of tobacco particles which are converted into a cake CK prior to reaching a cutting or severing station 19. The leader of the cake CK advances into the range of orbiting knives or cutters 21 which are mounted at the periphery of a cylindrical carrier 22 mounted in the frame F and driven by a discrete prime mover 23 here shown as an electric motor whose output element transmits torque to the shaft **22*a* of the carrier 22 by way of a chain or belt transmission 23*a***.

The sprocket wheels **6*a* and 6*b* of the lower chain conveyor 6 are mounted on shafts which are journalled in the frame F. The front sprocket wheel 6*a* is rotated by a variable-speed prime mover 7 (e.g., an electric motor) through the medium of a chain or belt drive 16. The shaft 8 for the rear sprocket wheel 4*b* of the upper chain conveyor 4 is also journalled in the frame F; however, the front sprocket wheel 9 of the upper chain conveyor 4 is movable up and down and is biased downwardly, as viewed in FIG. 1, by a fluid-operated cylinder and piston unit 11 or by analogous yieldable biasing means. The front sprocket wheel 9 is driven by a gear train 12, 13, 14 which derives motion from the sprocket wheel 6*a* of the lower chain conveyor 6**.

The cutting edges of the knives 21 are sharpened by a grinding wheel 24 which is driven by a motor **24*a*. The active surface of the grinding wheel 24 is treated by a dressing tool 26**.

The outlet of the path A between the chain conveyors 4 and 6 is defined by a mouthpiece including an upper portion 17 which shares the (up and down) movements of the front sprocket wheel 9 and a lower portion 18 which is fixedly secured to the frame F and constitutes a counterknife for the orbiting knives 21. The shreds which are formed in response to severing of successive increments of the cake CK are caused to descend into the inlet of a pneumatic conveyor PC which transports the shreds to the next processing station, e.g., to the drier of a conditioning unit which changes the moisture content of the shreds.

The rear portion of the lower chain conveyor 6 extends rearwardly beyond the rear portion of the upper chain conveyor 4 and is disposed at a level below a location 1 (hereinafter called stream building zone) which receives tobacco particles 2 from an apparatus embodying one form of the invention. The apparatus comprises conveyor means including a trough-shaped vibratory conveyor 27 which defines an elongated path B substantially or exactly in line with the elongated path A between the chain conveyors 4 and 6. The outlet of the path B is located at the stream building zone 1. The means of agitating the particles 2 of tobacco in the trough 27 comprises an eccentric **27*a* which is driven by a motor, not shown. The trough 27 is mounted on leaf springs 28 which are secured to the frame F. When the eccentric 27*a* rotates, the trough 27 performs recurrent movements which cause the particles 2 to advance toward the stream building zone 1**.

The means for feeding tobacco particles 2 into the trough 27 comprises a chute 33 which can deliver particles of tobacco at a variable rate. Such rate can be varied by a monitoring means including photocells 32 which are adjacent to the path B and serve to monitor the upper level of the mass of particles in the trough 27. When the height of such mass is too low, one of the photocells 32 transmits a signal to a control circuit 32*a* which increases the rate of delivery of particles via chute 33. If the height of the mass in the trough 27 is excessive, the other photocell 32 transmits a signal which causes the control circuit 32*a* to reduce the rate of tobacco feed. Thus, the photocells 32 cooperate with the control circuit 32*a* to insure that the quantity of tobacco particles in the trough 27 is always within a desired range. The manner in which the photocells 32 cooperate with the control circuit 32*a* to insure that the upper level of the mass of tobacco particles 2 in the trough 27 remains within the optimum range for the formation of an acceptable cake CK is preferably the same or similar to that described in commonly owned U.S. Pat. No. 4,037,712 granted July 26, 1977 to Waldemar Wochnowski except that the photocells 32 transmit signals which regulate the rate of supply of tobacco particles 2 via chute 33 rather than or in addition to regulating the speed of the motor 7. For example, the control circuit 32*a* can transmit signals to a variable-speed motor which drives a conveyor serving to draw tobacco particles from a hopper and to deliver the withdrawn particles into the chute 33.

The bottom wall 29 of the trough 27 is stepped, i.e., it comprises an upper section upstream and a lower section downstream of a transversely extending step 31 along which the particles 2 descend on their way toward the stream building zone 1. The bottom wall 29 slopes slightly downwardly and forwardly, i.e., toward the zone 1; however, it is also possible to employ a horizontal bottom wall. The step 31, which extends transversely of the path B, contributes to densification of the stream of particles 2 in the trough 27 even before such particles reach the stream building zone 1.

It is also within the purview of the invention to use the photocells 32 and the control circuit 32*a* solely for regulation of the speed of the motor 7, i.e., for regulation of the speed of the chain conveyors 4, 6 of the transporting unit 3 in response to variations of the height of the mass of particles 2 in the trough 27 downstream of the discharge end of the chute 33.

It has been found that the conveyor means including the trough 27 contributes to predictable orientation of particles 2 on their way toward the stream building zone 1. This, in turn, insures that the homogeneousness of the cake CK is constant or nearly constant and also that the particles 2 (particularly ribs) assume such positions that, even though they cannot be readily extracted by the knives 21, the particles are converted into relatively long shreds which are best suited for the making of a satisfactory tobacco filler stream. As a rule, the particles 2 are substantially horizontal and extend transversely of the direction of transport along the path A not later than when they reach the stream building zone 1.

The vibrating trough 27 insures a preliminary compacting or condensation of material on the bottom wall 29. If the particles 2 are ribs, they are converted into a substantially homogeneous stream of interlaced particles even before they descend onto the upper reach of the lower chain conveyor 6. Agitation of particles 2 in trough 27 insures that the majority of particles assume a horizontal position not later than on arrival at the outlet of the second path B. Some of the particles will make an acute angle with the direction of transport along the path B; however, the majority of particles will extend at right angles to such direction. This insures the formation of a homogeneous or nearly homogeneous cake. Moreover, and as already mentioned above, the knives 21 convert successive increments of the cake CK into elongated shreds which are more desirable than short tobacco.

Another important advantage of the improved apparatus is that its height is a fraction of the height of apparatus which are presently in use for delivery of tobacco particles to the compacting and transporting unit of a tobacco cutting or shredding machine. Presently known apparatus invariably employ an elongated vertical duct which accumulates a stack of tobacco particles at a level above the rear portion of the lower chain conveyor, and a rake or analogous means for intermittently advancing tobacco particles from the lower end of such duct into the spacebetween the upper and lower chain conveyors of the transporting unit.

Figure 2:
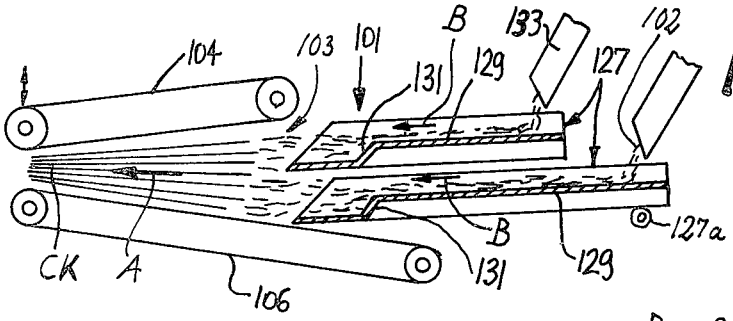
FIG. 2 is a fragmentary elevational view of the shredding machine and partly elevational and partly longitudinal sectional view of a second apparatus wherein the conveyor means for tobacco particles comprises two vibratory troughs disposed at different levels.

FIG. 2 shows a portion of a modified apparatus wherein all such parts are identical with or clearly analogous to corresponding parts of the structure of FIG. 1 are denoted by similar reference characters plus 100. The conveyor of the tobacco delivering apparatus of FIG. 2 comprises several troughs 127 which are disposed at different levels (one above the other) and receive particles 102 of tobacco from discrete feeding ducts 133. The bottom walls 129 of the troughs 127 are configurated in the same way as the bottom wall 29 of the trough 27, i.e., each bottom wall 129 comprises a first or preceding section at a higher level, a second or next-following section at a lower level and a transversely extending step 131 between such sections. The outlets of the paths B which are defined by the troughs 127 terminate at the stream building zone 101, i.e., at a level above the rear portion of the upper reach of the chain of the lower chain conveyor 106. The paths which are defined by the troughs 127 are at least substantially parallel to the path A along which the cake CK moves between the chain conveyors 104, 106 of the transporting unit 103 and on toward the cutting station.

The paths B which are defined by the troughs 127 may but need not be exactly parallel to each other. For example, the lower path B may be horizontal and the upper path B may slope slightly forwardly and downwardly toward the stream building zone 101. The apparatus of FIG. 2 can be used with advantage when the cutting machine is designed to produce a large quantity of shreds per unit of time. The level of the masses of particles 102 in the troughs 127 can be monitored in the same way as described in connection with FIG. 1, and the signals which are generated by the transducer or transducers of the moitoring means can be used to regulate the rate of delivery of particles 102 via respective chutes or ducts 133 and/or the speed of the motor which drives the chain conveyors 104 and 106.

Figure 3:
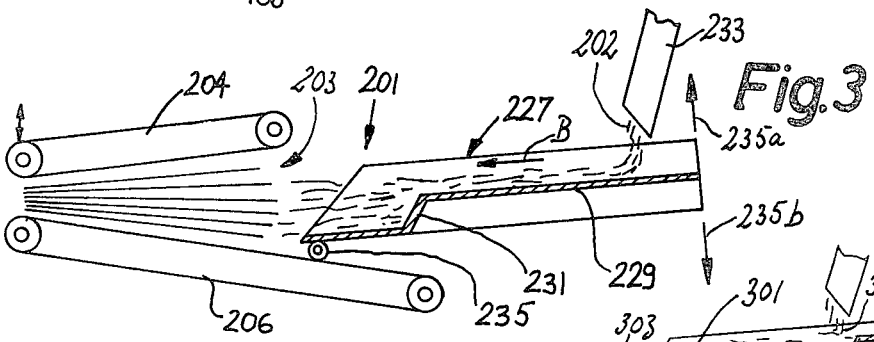
FIG. 3 is a view similar to that of FIG. 2 but showing a third apparatus whose vibratory trough is pivotable in the region of its discharge end.

FIG. 3 shows a third apparatus wherein all such parts which are identical with or clearly analogous to corresponding parts of the apparatus of FIG. 1 are denoted by similar reference characters plus 200. The front end portion of the trough 227 (in the region of the outlet of the path indicated by the arrow B) is pivotable about a horizontal axis which is defined by a roller 235. The directions in which the trough 227 is pivotable are indicated by arrows, 235*a*, 235*b*. Such adjustability of the trough 227 is desirable in order to insure that the rate of delivery of tobacco particles 202 to the cutting station matches or closely approximates the selected output of the cutting machine. It is clear that the pivot means 235 can be installed at the rear end of the trough 227, i.e., the trough can pivot about its rear end to move the outlet of the path B nearer to or further away from the upper reach of the chain conveyor 206. The rate of delivery of particles 202 to the zone 201 is increased by increasing the inclination of the trough 227.

Figure 4:
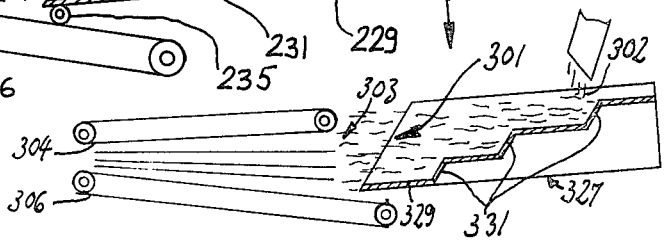
FIG. 4 is a view similar to that of FIG. 2 or 3 but showing a vibratory trough whose bottom wall is formed with several steps.

FIG. 4 shows a further apparatus with a modified trough-shaped conveyor 327. All such parts of this apparatus which are identical with or clearly analogous to corresponding parts of the apparatus of FIG. 1 are denoted by similar reference characters plus 300. The bottom wall 329 of the trough 327 comprises several transverse steps 331 which are disposed at different levels so that the particles 302 repeatedly descend by gravity on their way toward the stream building zone 301. The apparatus of FIG. 4 has been found to be particularly suited for the advancement of tobacco leaf laminae toward the upper reach of the lower chain conveyor 306. Repeated showering of laminae on their way toward the zone 301 insures a highly satisfactory preliminary homogenization before the particles are converted into a cake. The number of steps 331 can be reduced to two or increased to four or more. The eleasticity of laminae exceeds the eleasticity of tobacco ribs so that a mass which consists of laminae can undergo a highly satisfactory preliminary compacting and homogenization upstream of the transporting unit 303 including the chain conveyors 304 and 306.

Figure 5:
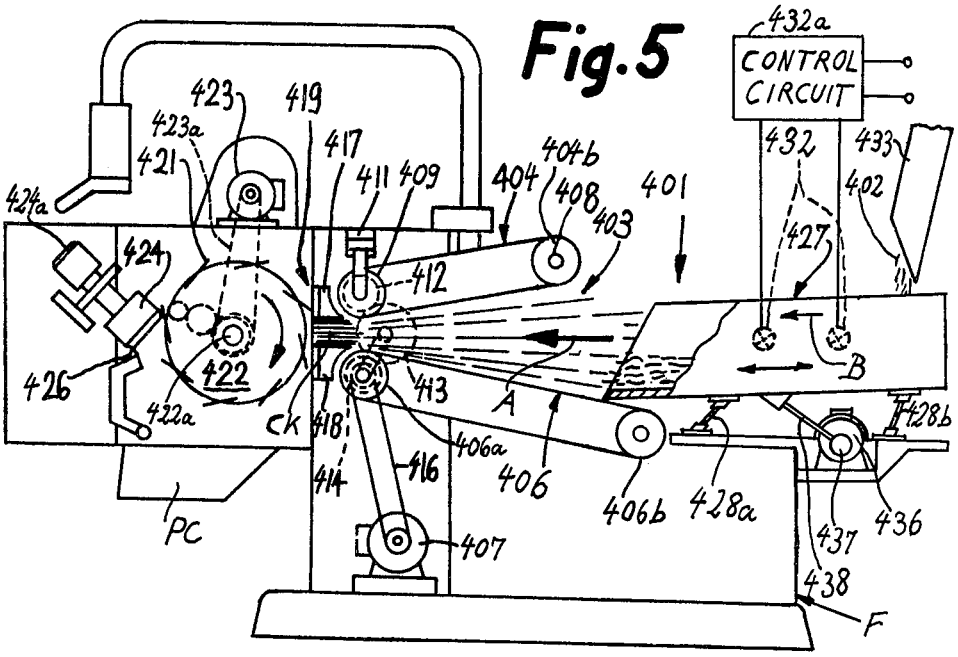
FIG. 5 is a schematic side elevational view of a tobacco shredding machine and a schematic partly longitudinal sectional view of a further tobacco delivering apparatus.

FIG. 5 illustrates a tobacco shredding machine wherein all such parts which are identical with or clearly analogous to those shown in FIG. 1 are denoted by similar reference characters plus 400. The tobacco delivering apparatus of FIG. 5 is also similar to that of FIG. 1 and, therefore, its parts are designated by similar reference characters plus 400.

The trough-shaped vibratory conveyor 427 of FIG. 5 has a bottom wall 429 which makes with a horizontal plane an angle of approximately 5 degrees and defines an elongated path B having a first portion nearer to and a second portion more distant from the stream building zone 401. The bottom wall 429 of the trough 427 is inclined forwardly and downwardly, i.e., toward the upper reach of the chain conveyor 406. That (front) section or portion of the trough 427 which defines the first portion of the elongated path B for tobacco particles 402 is supported by elongated elastic elements 428 in the form of one or more pairs of leaf springs **428*a* or the like. These leaf springs make with the bottom wall 429 a first accute angle of approximately 50 degrees. That (rear) portion or section of the trough 427 which defines the second portion of the path B is supported by elongated elastic elements in the form of one or more pairs of leaf springs 428*b* which make with the bottom wall 429** a larger acute angle of approximately 70 degrees.

The means for agitating the trough 427 comprises an electric motor 436 whose output element drives an eccentric 437 for one or more connecting rods 438. Owing to the aforediscussed inclination of leaf springs **428*a* and 428*b*, the motor 436 imparts to the front section or portion of the trough 427 a recurrent movement having a predominantly vertical component, and the rear portion or section of the trough 427 receives a recurrent movement having a predominantly horizontal component. This will be readily appreciated since the extent to which the front leaf springs 428*a* move the corresponding portion of the bottom wall 429 up and down is much more pronounced than the extent of up- and down-movement of the rear portion of this bottom wall under the action of leaf springs 428*b*. Pronounced up- and down-movements of the front portion of the bottom wall 429 result in pronounced stratification of tobacco particles (e.g., ribs) 402 in the front portion of the trough 427, and the superimposed strata of the accumulated and oriented particles are closely adjacent to each other, i.e., the body or stream of particles reaching the upper reach of the chain conveyor 406 is dense. This, in turn, insures that the front end of such stream does not tend to bulge upwardly and its constituents do not tend to change their orientation as a result of contact with particles on the chain conveyor 406. It has been found that the orientation of particles 402 which leave the zone 401 and enter the space between the chain conveyors 404, 406 does not change at all. There is no pileup and/or other undesirable shifting, bulging and/or analogous stray movement of particles leaving the zone 401. In the absence of pronounced stratification in the first or left-hand portion of the path B which is defined by the trough 427, the particles 402 reaching the space between the chain conveyors 404, 406** would be likely to assume vertical or nearly vertical positions which, in turn, would affect the quality of the shredding action.

The particles 402 which are delivered by the chute 433 into the rear portion of the path B are moved substantially horizontally because the inclination of leaf springs **428*b* with respect to a vertical plane is relatively small. Therefore, such particles are rapidly advanced toward the zone 401 which insures that the conveyor 406 receives a continuous stratified body of properly oriented particles 402 even if the rate at which the chute 433 delivers particles into the trough 427 fluctuates within a wide range. Thus, the rear portion of the trough 427** imparts movements in the general direction of movement of the cake CK, and the front portion of the trough imparts movements substantially at right angles to such direction.

The inclination of the bottom wall 429 can be varied without departing from the spirit of the invention. Also, the inclination of the leaf springs **428*a*, 428*b* can be changed, as long as the front portion of the trough 427 receives a recurrent movement having a predominantly vertical component and the rear portion of the trough 427 receives a recurrent movement having a predominantly horizontal component. The means for agitating the trough 427** can also be modified as long as the two portions of the trough are moved in a manner as outlined above.

The improved tobacco delivery apparatus is susceptible of many additional modifications. For example, the means for agitating the particles in the conveyor means can include means for regulating the amplitude and/or frequency of vibrations of the trough or troughs. Such adjustments will be carried out in order to insure that the rate of delivery of particles to the stream building zone matches or closely approximates the output of the cutting machine. The frequency and/or amplitude of vibrations can be changed when particles of a first type are followed by particles of a second type, when the speed of the chain conveyor is changed and/or for certain other reasons. Furthermore, the monitoring means may be used to regulate the frequency and/or amplitude of vibrations of the trough or troughs to thereby insure an optimum rate of delivery of tobacco particles to the stream building zone. All such modifications will be readily understood by persons having the required skill in this art without additionl illustrations.

Without further analysis, the foregoing will so fully reveal the gist of the present invention that others can, by applying current knowledge, readily adapt it for various applications without omitting features that, form the standpoint of prior art, fairly constitute essential characteristics of the generic and specific aspects of our contribution to the art and, therefore, such adaptations should and are intended to be comprehended within the meaning and range of equivalence of the claims.

We claim:

1. In a method of comminuting particles of tobacco, such as ribs of tobacco leaves, wherein a stream of tobacco particles is built up at a location remote from a cutting station and the stream is condensed diuring transport toward said station, the improvement which coprises the steps of transporting said stream lengthwise along a first substantially horizontal path; conveying particles of tobacco toward said location substantially in the longitudinal direction of said stream and along at least one second substantially horizontal path having a discharge end at said location, said second path further having a first portion nearer to and a second portion more distant from said location; and agitating the particles in the course of said conveying step, including imparting to the particles in said first portion of said second path a first recurrent movement having a predominantly vertical component and imparting to the particles in said second portion of said second path a second recurrent movement having a predominantly horizontal component.

2. The improvement of claim 1, wherein said agitating step comprises vibrating the particles in said second path to thereby orient the particles so that at least the majority of particles which reach said location are substantially horizontal and extend substantially transversely of said stream.

3. The improvement of claim 1, further comprising the steps of feeding particles into said second path at a variable rate, monitoring the quantity of particles in said second path, and varying said rate when the monitored quantity deviates from a predetermined range of quantities.

4. The improvement of claim 1, wherein said conveying step comprises advancing particles of tobacco toward said location along a plurality of substantially parallel second paths.

5. The improvement of claim 1, wherein said second path has a plurality of successive sections with each preceding section disposed at a level above the next-following section so that the particles descend during transfer from a preceding section into the next-following section.

6. In a machine for comminuting particles of tobacco, such as ribs of tobacco leaves, wherein a transporting unit advances a stream of tobacco particles lengthwise from a location which is remote from a cutting station to said cutting station, wherein said unit condenses the stream between said location and said station, and wherein successive increments of the condensed stream are shredded by at least one moving tool at said station, the improvement which comprises conveyor means defining at least one elongated path which is at least substantially in line with said stream, said conveyor means having outlet means at said location and including a first portion which defines a first portion of said path and is nearer to said location and a second portion which defines a second portion of said path and is more distant from said location; means for feeding particles of tobacco to said conveyor means whereby such particles advance toward and enter said location to form said stream; and means for agitating the particles in said path, including means for imparting to the particles ot tobacco in said first portion of said path a first recurrent movement having a predominantly vertical component and means for imparting to the particles of tobacco in said second portion of said path a second recurrent movement having a substantially horizontal component.

7. The improvement of claim 6, wherein said conveyor means comprises a substantially horizontal trough having front and rear sections respectively constituting said first and second portions of said conveyor means, first elongated elastic elements supporting said front section and second elongated elastic elements supporting said rear section, said first elastic elements making with the longitudinal direction of said path a first acute angle and said second elastic elements making with the longitudinal direction of said path a larger second acute angle, said means for imparting said first and second recurrent movements including means for vibrating said trough.

8. The improvement of claim 7, wherein said first angle is approximately 50 degrees and said second angle is approximately 70 degrees.

9. The improvement of claim 7, wherein said trough has a bottom wall making with a horizontal plane an angle of approximately 5 degrees.

10. The improvement of claim 6, wherein said agitating means comprises means for vibrating said conveyor means.

11. The improvement of claim 6, wherein aid conveyor means comprises a stepped bottom wall so that the particles which are supplied by said feeding means descend from at least one higher level to at least one lower level during advancement toward said location.

12. The improvement of claim 11, wherein said bottom wall includes at least one step which extends substantially transversely of said path.

13. The improvement of claim 11, wherein said bottom wall comprises a plurality of successive steps each extending substantially transversely of said path, each next-following step being disposed at a level below the preceding step.

14. The improvement of claim 6, wherein said conveyor means comprises at least one trough and said agitating means comprises means for vibrating said trough.

15. The improvement of claim 6, wherein said path is substantially horizontal.

16. The improvement of claim 6, wherein said path slopes slightly downwardly toward said location.

17. The improvement of claim 6, wherein said conveyor means comprises a trough and means for pivotally mounting said trough so that the trough can turn about a substantially horizontal axis extending transversely of said path.

18. The improvement of claim 17, wherein said axis is disposed in the region of said outlet means.

19. The improvement of claim 6, wherein said conveyor means comprises a plurality of troughs and said agitating means comprises means for vibrating said troughs.

20. The improvement of claim 19, wherein said troughs are substantially parallel to and are disposed above each other.

21. The improvement of claim 6, wherein said feeding means includes means for supplying particles at a variable rate, and further comprising means for monitoring the quantity of particles in at least one portion of said path and means for varying said rate when the monitored quantity deviates from a predetermined range of quantities.

* * * * *